United States Patent [19]

Laciak et al.

[11] 4,143,566

[45] Mar. 13, 1979

[54] SEMIAUTOMATIC STRIP FEED CONTROL

[75] Inventors: Francis M. Laciak, Brooklyn Park; Gerald R. Strunc, Maple Grove, both of Minn.

[73] Assignee: Pako Corporation, Minneapolis, Minn.

[21] Appl. No.: 868,034

[22] Filed: Jan. 9, 1978

[51] Int. Cl.[2] ..... B65H 17/06; B26D 7/00

[52] U.S. Cl. ..... 83/42; 83/203; 83/241; 83/249; 83/250; 226/2; 226/136; 226/141

[58] Field of Search ..... 83/42, 203, 204, 205, 83/241, 249, 250, 251; 226/2, 136, 139, 141

[56] References Cited

U.S. PATENT DOCUMENTS

| | | | |
|---|---|---|---|
| 3,656,673 | 4/1972 | Erickson | 226/136 X |
| 4,029,250 | 6/1977 | Tall | 226/136 X |

*Primary Examiner*—J. M. Meister

*Attorney, Agent, or Firm*—Kinney, Lange, Westman & Fairbairn

[57] ABSTRACT

The present invention is a strip feed control which is particularly useful in photographic systems such as film and paper cutters, film notchers, and printers. The photographic strip material is fed by a predetermined feed length during each operating cycle. The operator of the system visually monitors the position of the strip with respect to a reference position or indicator along the feed path and provides adjustment signal through an operator control knob. The strip position is moved in accordance with the desired adjustments, and the predetermined feed length for the next operating cycle is derived from the predetermined feed length of the just completed operating cycle, together with any adjustment in the strip position which was made by the operator.

20 Claims, 12 Drawing Figures

SEMIAUTOMATIC STRIP FEED CONTROL

BACKGROUND OF THE INVENTION

The present invention relates to strip or web feeding systems. In particular, the present invention relates to strip or web feeding systems for advancing of a strip of photographic material (i.e. film or print paper) in a photographic system.

In the photographic processing business, there is need for strip or web feeding systems which advance photographic film for photographic print paper by accurate distances. Photographic equipment which require these strip feeding systems include photographic printers, photographic film cutters, photographic film notchers, and phtotgraphic paper cutters.

In general, there are three types of strip feeding systems which may be used in a photographic system: manual, automatic, and semiautomatic. In manual systems, the entire movement of the strip is accomplished by the operator. Each strip feed is accomplished by the operator moving the film either directly or through some form of mechanical linkage.

Automatic strip feed systems typically include sensors which sense indicia on the film or paper which indicate a desire operating point or stopping point for the strip. Since no operator movement or positioning of the strip is required, the automatic feed systems are much faster and more efficient than a manual system.

Semiautomatic systems provide an alternative to the manual systems in those cases where the photographic strip material does not have indicia. Semiautomatic film and paper cutters, semiautomatic film notchers, and semiautomatic film needs for photographic printers have been developed. These systems provide higher speed operation than the manual strip feed systems, less complex and less expensive than automatic systems, and are capable of handling strips with no indicia.

In general, semiautomatic feed control systems have in the past used a moveable cursor or pointer to indicate the location of the next desired cut, notch, or location for printing. Examples of semiautomatic systems have movable cursors include Schwardt U.S. Pat. No. 3,315,862; Erickson U.S. Pat. No. 3,656,673; Tall U.S. Pat. No. 4,029,250; and a co-pending patent application by G. Strunc and W. Osby, Ser. No. 791,704 filed Apr. 28, 1977, and assigned to the same assignee as the present application.

In some cases, however, the moveable cursor-type control is disadvantageous. First, the moveable cursor system must include mechanical/electrical components which take up space in the equipment. In some photographic equipment, space considerations prevent the addition of a movable cursor-type system. Second, the movable cursor system requires extra moving parts.

SUMMARY OF THE INVENTION

The present invention is a semiautomatic strip feed system which avoids the disadvantages of the prior art semiautomatic strip feed systems. The system of the present invention does not require a movable pointer or cursor to determine the proper feed lengths.

In the present invention, strip material is fed by a predetermined feed length during an operating cycle. The operator then provides signals which indicate any desired adjustments in the position of the strip along the path in order to align a selected location on the strip with a reference position along the path. These signals are used to move the strip so as to adjust the position of the selected location to the reference position. The predetermined feed length for the next operating cycle is determined from the predetermined feed length of the preceding cycle and any adjustments which were made in the strip material position during that preceding operating cycle.

DETAILED DESCRIPTION OF THE PREFERRED EMBODIMENTS

In the following description of the preferred embodiments, the present invention will be described in the context of a photographic paper cutter of the type generally described in a co-pending patent application by Strunc and Laciak entitled "Microprocessor Controlled Paper Cutter", Ser. No. 838,064 filed Sept. 29, 1977, and assigned to the same assignee as the present application. It should be understood, however, that the present invention is equally applicable to photographic film cutters and notchers, film feed systems for photographic printers, and other systems requiring a semiautomatic strip feed.

Figure 1:
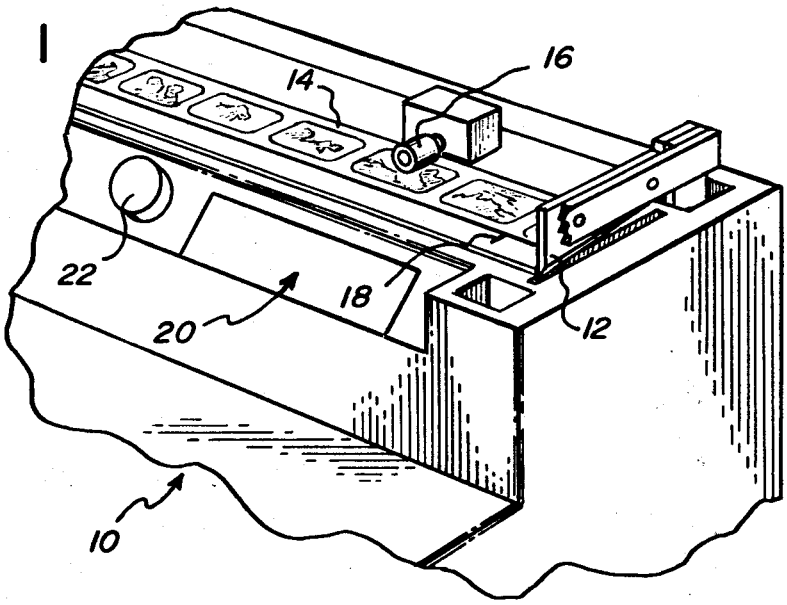
FIG. 1 shows a photographic paper cutter which uses the semiautomatic strip feed system of the present invention.

FIG. 1 shows the photographic paper cutter 10, which includes a knife assembly 12 for cutting individual prints from a strip of photographic print paper 14. Strip 14 is driven by a drive system including pinch roller drive assembly 16 and a stepper motor (not shown in FIG. 1).

Positioned along the path of strip 14 is a reference mark 18. In the preferred embodiment, reference mark 18 provides an indication of a reference location which is a known distance from knife assembly 12. The known distance is preferably less than the shortest print which may be cut by paper cutter 10. The position of reference mark 18 with respect to knife assembly 12 may differ depending upon the particular system, and in some cases the knife assembly itself may be positioned at the reference location. In the particular embodiment shown in FIG. 1, however, reference mark 18 is physically separated from knife assembly 12, because knife assembly 12 is an essentially closed assembly which cannot be easily viewed by the operator. It is important to the operation of the present invention that the reference mark 18 or some other indication of the reference location be easily visible to the operator.

Paper cutter 10 includes an operator control panel 20 through which the operator may select modes of operation and may set in certain nominal values to be used in the operation of paper cutter, such as a nominal feed length to be used. Also included in the embodiment shown in FIG. 1 is an operator control knob 22, which is electrically coupled to the feed control system to permit the operator to adjust the position of the strip 14 in either a forward or reverse direction along its path.

In operation, the operator initially aligns a desired cut location of a print on strip 14 with reference mark 18. The operator then initiates a paper feed-and-cut operating cycle. Paper strip 14 is first advanced by the known distance between reference mark 18 and knife assembly 12. This causes the desired cut location to be exactly aligned with knife assembly 12. Knife assembly 12 then cuts the paper at the desired cut location and strip 14 is again fed, this time by the remaining distance which is equal to a predetermined feed length (e.g. the nominal feed length selected by the operator on operator control 20) less the known distance. When this remaining distance has been fed, the cycle is completed. The operator may then observe whether the next desired cut location is aligned with reference mark 18. If it is aligned with reference mark 18, the operator may initiate another cycle since the strip 14 will be cut at the desired cut location during that next cycle.

If, on the other hand, the desired cut location does not correspond to the reference mark 18, the operator may adjust the position of strip 14 by turning knob 22 in either a clockwise or counter-clockwise direction. Movement of knob 22 is electrically sensed, and strip 14 is driven in either a forward or reverse direction until the operator sees that the desired cut location is aligned with reference mark 18 and stops turning knob 22. At that point, the operator initiates another operating cycle, and the cut made by knife assembly 12 is at the desired cut location.

During the second cycle, the predetermined feed length which strip 14 will be automatically advanced is determined by the predetermined feed length of the previous cycle plus or minus whatever adjustment was made by the operator through control knob 22. With each succeeding cycle, the predetermined feed length is revised or updated to reflect any operator adjustment made during the preceding cycle.

If the spacing of the prints is very uniform, the number of operator adjustments will be few. If, on the other hand, the spacing between prints varies significantly, it may be necessary to adjust the position of strip 14 after each cycle in order to align the desired cut location with reference mark 18. In either case, the present invention provides a highly effective method of semiautomatic strip feed control without the necessity of a movable pointer or cursor.

One important advantage of the present invention is that it requires a minimum of additional hardware in order to add the semiautomatic feed control as an optional feature to an existing automatic paper cutter. No movable cursor or mechanical linkages are required, and no elaborate cursor position-sensing system is required by the present invention. Instead, the present invention requires the addition of operator control knob or similar operator control and a correction circuit which generates signals indicative of changes in position of the operator control knob.

Figure 2:
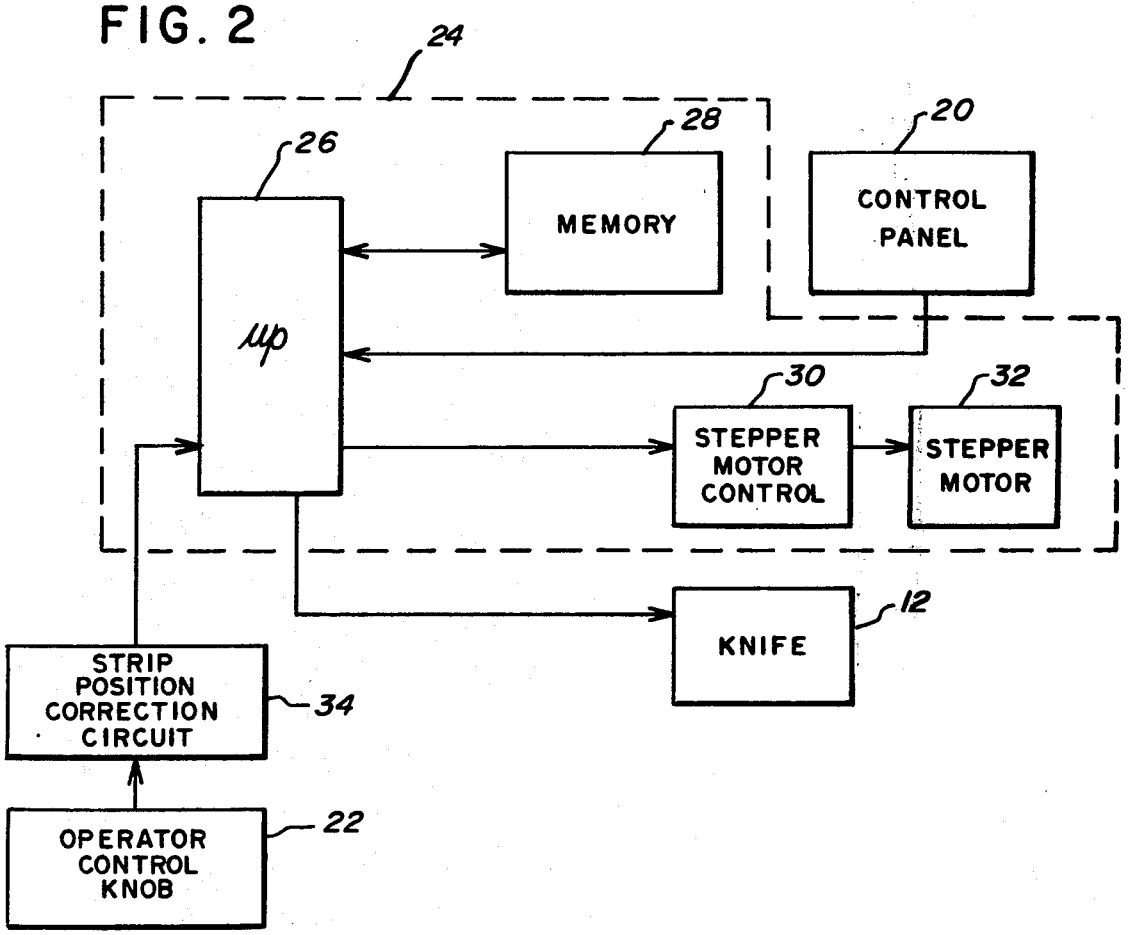
FIG. 2 is a block diagram of an electrical control for the strip feed system of FIG. 1.

FIG. 2 illustrates an electrical block diagram of a control system used in a preferred embodiment of the paper cutter shown in FIG. 1. In the embodiment shown in FIG. 2, the control system 24 includes a microprocessor 26, memory 28, stepper motor control 30, and stepper motor 32, which may be similar to the microprocessor, memory, stepper motor control, and stepper motor described in the previously mentioned application by Strunc and Laciak. Control system 24 receives inputs from control panel 20 and controls the paper feed and cutting operation through stepper motor 32 and knife 12.

The semiautomatic strip feed of the present invention may be added to this system merely by adding operator control knob 22 and strip position correction circuit 34 to the hardware already existing in paper cutter 10. Strip position correction circuit 34 derives digital signals indicative of the position (or change in position) of operator control knob 22. Microprocessor 26 compares the signals from strip position correction circuit 34 both before and after movement of operator control knob 22 and generates appropriate stepper motor control signals for stepper motor control 30. In addition, microprocessor 26 modifies the predetermined feed length stored in memory 28 by any adjustment made by the operator. The stored predetermined feed length is updated after each operating cycle to reflect any changes or adjustments in position which have been made by the operator.

Figure 3:
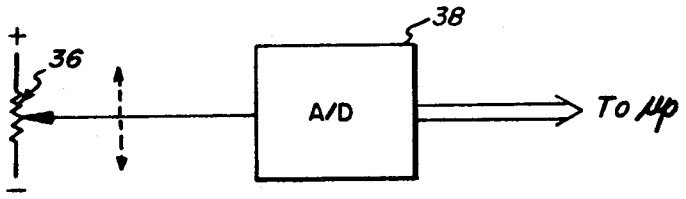
FIGS. 3 and 4 are block diagrams illustrating two possible strip position correction circuits used to generate position adjust signals from the position of an operator control.
Figure 4:
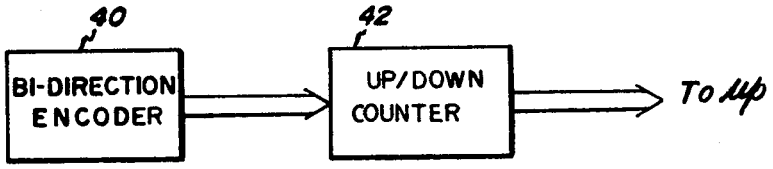

FIGS. 3 and 4 illustrate two alternative embodiments of strip position correction circuit 34. In the embodiment shown in FIG. 3, operator control knob 22 is connected to the potentiometer 36, which is wired as an adjustable voltage divider to provide an output voltage that is proportional to the position of control knob 22. This output voltage is converted to a multi-bit digital position value by A/D converter 38. Microprocessor 26 compares the current digital position value to a previously read digital position value. If the two values are different, microprocessor 26 causes stepper motor control 30 and stepper motor 32 to drive paper strip 14 in the appropriate direction by the number of steps determined by the difference of the two digital position values.

If operator control knob 22 has been moved, this indicates that the distance that the strip 14 was just advanced (i.e. the predetermined feed length) was incorrect by the amount corresponding to the difference between the two digital position values received from strip position correction circuit 34. Microprocessor 26 updates the predetermined feed length (which is a first digital value stored in memory 28) by the number of adjustment steps (i.e. a second digital value) which were required by the operator so that the next paper feed will equal the adjusted feed length of the just completed operating cycle.

In the embodiment shown in FIG. 4, the digital position values supplied to microprocessor 26 are derived from bidirectional encoder 40 which is connected to operator control knob 22. As control knob 22 is moved, bidirectional encoder provides pulses to up/down counter 42. The count in up/down counter 42 is supplied to microprocessor 26. The total movement and direction of movement of control knob 22 is determined by mircoprocessor 26 by comparing digital position values from up/down counter 42 both before and after control knob 22 has been moved. In one preferred embodiment, bidirectional encoder 40 and up/down counter 42 are of the general type described in the previously mentioned co-pending application by Strunc and Osby.

FIGS. 5A–5D and FIGS. 6A–6D illustrate two possible conditions which can occur during a paper feed cycle. In the cycle shown in FIGS. 5A–5D, the predetermined feed length stored in memory 28 is less than the desired feed length, while in FIGS. 5A–5D the predetermined feed length exceeds the desired feed length.

Figure 5A:
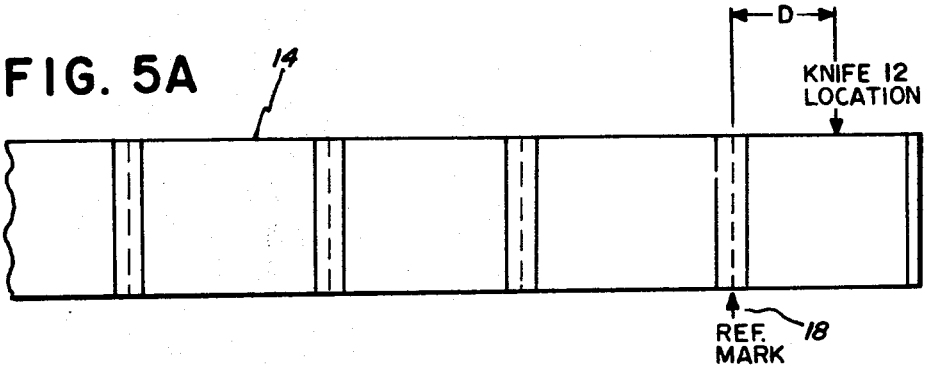
FIGS. 5A–5D illustrate an operating cycle in which the predetermined feed length during the operating cycle is less than the desired feed length.
Figure 5B:
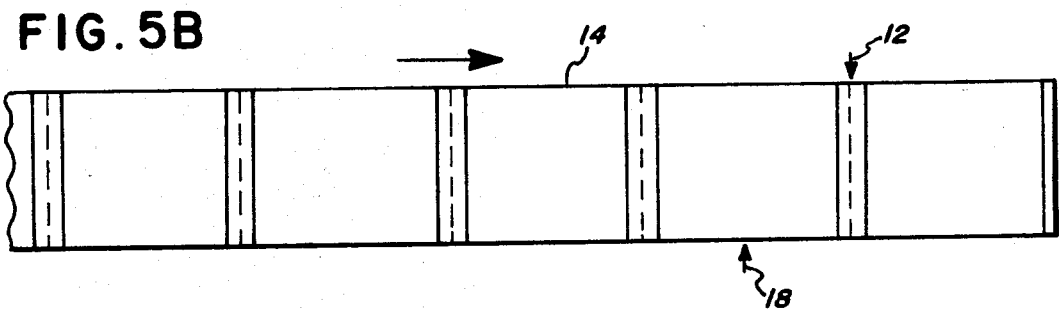

As shown in FIG. 5A, the desired cut location of strip 14 is first aligned with reference mark 18. When an operating cycle is initiated, strip 14 is first advanced by the known distance D, which is the distance from reference mark 18 to the knife location. FIG. 5B illustrates strip 14 after it has been moved by distance D. At this point, knife assembly 12 cuts strip 14 at the desired cut location.

Figure 5C:
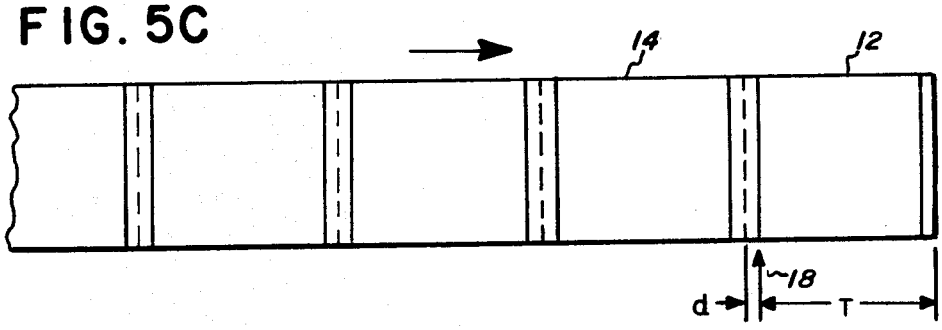

After the cutting operation has been completed, the strip feed is again commenced and strip 14 is driven by the remaining distance which corresponds to the predetermined feed length T less the known distance D which has already been fed. As shown in FIG. 5C, predetermined feed length T is not sufficient to align the next desired cut location with reference mark 18. Instead, strip 14 must be advanced by an additional distance d in order to align the desired cut location with reference mark 18.

Figure 5D:
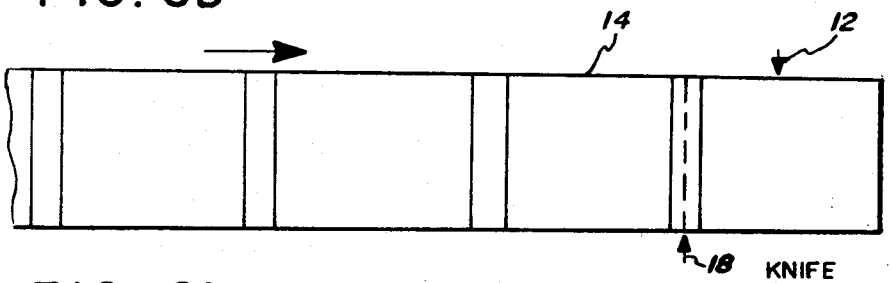
Figure 6A:
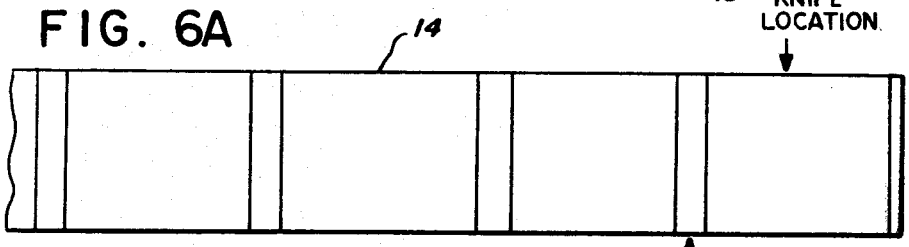
FIGS. 6A–6D illustrate an operating cycle of the strip feed system in which the predetermined feed length during the operating cycle exceeds the desired feed length.
Figure 6B:
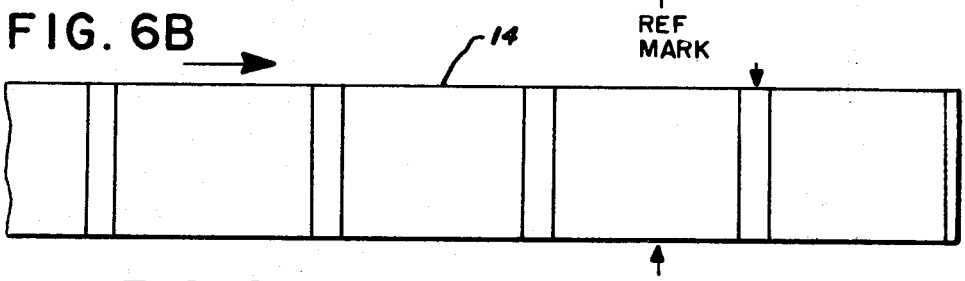
Figure 6C:
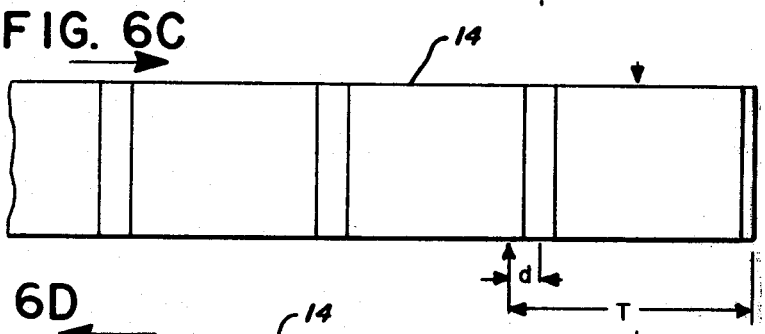
Figure 6D:
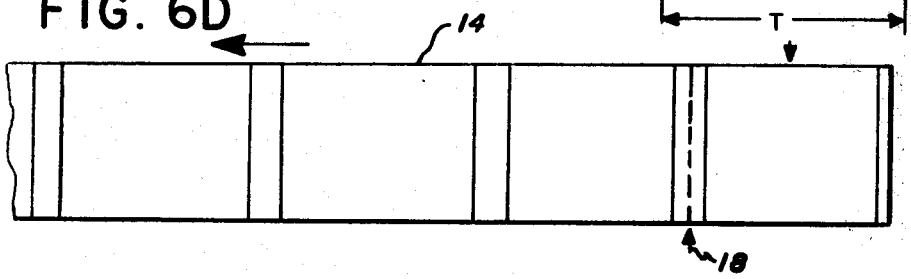

The additional adjustment of the position of strip 18 is performed by the operator by turning operator control knob 22 until the desired cut location is aligned with reference mark 18. FIG. 5D shows strip 14 after its position had been adjusted.

During the next operating cycle, the new predetermined total feed length $T_{new} = T + d$. In this way, the succeeding predetermined feed length is always determined by the total feed length of the previous operating cycle, together with whatever operator adjustment was required.

FIGS. 6A–6D illustrate the situation in which the predetermined feed length T exceeds the desired feed length by a distance d. In this case the operator, by turning operator control knob 22, backs up or reverses the direction of the strip 14 in order to align the desired cut location with reference mark 18. During the next operating cycle, the new predetermined feed length $T_{new} = T - d$.

As illustrated in FIGS. 5A–5D and 6A–6D, the present invention involves updating or correcting the predetermined feed length after each cycle for use in the next cycle. In this way, the operator adjustments are used not only in the current cycle, but also to correct the feed length during the next cycle.

In one advantageous embodiment of the present invention, control panel 20 includes a thumbwheel switch which permits the operator to select the number of prints to be cut before any adjustments may be made through control knob 22. For example, the switch may be set to the number "3", so that when the start switch is depressed the cutter will perform three paper feed-and-cut cycles using the predetermined feed length T before it would stop and allow the operator to make any adjustments using control knob 22. Since the variation in print length is rather small between one or two adjacent prints, the use of this multiple print cutting feature before adjustment permits higher throughput of the machine.

When the photogrpahic paper cutter is of the type generally described in the co-pending patent application by Strunc and Laciak, the switch which selects the number of prints to be cut before adjustment is the Maximum Number of Prints switch. When the semiautomatic cutting mode is selected, the Maximum Number of Prints switch indicates the number of prints to be cut before the operator may again make an adjustment with control knob 22. When the automatic mode is selected, the Maximum Number of Prints switch similarly limits the number of prints which may be cut automatically before the printer is stopped.

In conclusion, the present invention is a highly advantageous semiautomatic strip feed system which is particularly useful in photographic systems such as paper and film cutters, film notchers, and printers. The present invention overcomes the disadvantages associated with the prior art systems having a moveable cursor or pointer.

Although the present invention has been described with reference to preferred embodiments, workers skilled in the art will recognize that changes may be made in form and detail without departing from the spirit and scope of the invention.

What is claimed is:

1. A strip feed system comprising:

strip feed means for feeding a strip along a path in response to feed control signals and strip position adjust signals;

strip feed control means for providing feed control signals which result in a strip feed of a predetermined feed length;

operator control means for providing strip position adjust signals indicative of desired adjustments in the position of the strip along the path; and feed length determining means for determining the predetermined feed length for a succeeding strip feed cycle from the predetermined feed length and the desired adjustments in position from a preceding strip feed cycle.

2. The strip feed system of claim 1 and further comprising:

a reference position along the path.

3. The strip feed system of claim 2 and further comprising operating means for performing an operation on the strip, the operating means being positioned along the path a known distance from the reference position.

4. The strip feed system of claim 3 wherein the feed control signals cause the strip feed means to advance the strip first by the known distance and then by a remaining distance equal to the predetermined feed length less the known distance.

5. The strip feed system of claim 4 wherein the operating means performs an operation on the strip after the strip has been fed the known distance and before the strip is fed the remaining distance.

6. The strip feed system of claim 5 wherein the strip feed control means comprises:

means for storing a first digital value indicative of the predetermined feed length; and means for deriving the feed control signals from the first digital value.

7. The strip feed system of claim 6 wherein the operator control means comprises:

means for generating a second digital value indicative of a desired adjustment in strip position; and means for deriving the strip position adjust signals from the second digital value.

8. The strip feed system of claim 7 wherein the means for generating a second digital value comprises:

an operator control knob; and means for deriving a second digital value from the movement of the operator control knob.

9. The strip feed system of claim 8 wherein the means for deriving a second digital value comprises:

potentiometer means connected to the operator control knob for providing analog signals indicative. of control knob position;

A/D converter means for converting the analog signals to digital signals; and comparing means for comparing the digital signals from the A/D converter and deriving a second digital value from the comparison which is indicative of the amount the operator control knob has moved.

10. The strip feed system of claim 8 wherein the means for deriving a second digital value comprises:

bidirectional encoder means for providing encoder signals when the operator control knob is moved;

up/down counter means for counting in response to the encoder signals; and comparing means for comparing counts from the up/down counter and deriving a second digital value from the comparison which is indicative of the amount the operator control knob has moved.

11. The strip feed system of claim 7 wherein the feed length determining means determines the predetermined feed length by deriving a new first digital value from the first and second digital values used in the preceding feed cycle.

12. The strip feed system of claim 1 and further comprising:

means for selecting a number of strip feed cycles using the same predetermined feed length before permitting the operator control means to provide strip position adjust signals.

13. A method of feeding a strip along a path, the method comprising:

storing a first digital value which determines a feed length for the strip;

feeding the strip by the feed length determined by the first digital value;

providing a second digital value indicative of a desired adjustment of the strip position along the path with respect to a reference position;

adjusting the strip position along the path as a function of the second digital value;

modifying the first digital value as a function of the second digital value; and replacing the stored first digital value with the modified first digital value for use in determining a succeeding feed length.

14. The method of claim 13 wherein feeding the strip comprises:

feeding the strip a known distance from the reference location to an operating device; and feeding the strip a remaining distance equal to the feed length determined by the first digital value less the known distance.

15. The method of claim 14 and further comprising:

energizing the operating device to perform an operation on the strip after the known distance has been fed and before the remaining distance has been fed.

16. In a photographic system having operating means positioned along a path of a photographic strip material for performing operations on the strip material, a strip feed system comprising:

strip feed means for feeding the strip material in response to control signals;

operator adjust means for providing signals indicative of desired adjustments in the strip material position along the path to align a selected location on the strip material with a reference position along the path; and control means for providing control signals to the strip feed means to cause the strip material to be fed by a predetermined feed length during an operating cycle and to cause the strip feed means to adjust the position of the strip material by an amount determined by the signals from the operator adjust means, the control means determining the predetermined feed length of each operating cycle from the predetermined feed length and the adjustments in strip material position of a preceding operating cycle.

17. The system of claim 16 wherein the reference position is a known distance from the operating means.

18. The system of claim 17 and further comprising an indicator positioned along the path at the reference position.

19. The system of claim 18 wherein the control means provides control signals to the strip feed means to feed the strip material by the known distance and then by a remaining distance equal to the predetermined feed length less the known distance, and wherein the control means provides energizing signals to the operating means to cause the operating means to perform an operation on the strip material after the strip material has been fed the known distance but before the strip material has been fed the remaining distance.

20. The system of claim 16 wherein the operating means is a knife assembly.

* * * * *